US007546887B2

(12) United States Patent
Schwab

(10) Patent No.: US 7,546,887 B2
(45) Date of Patent: Jun. 16, 2009

(54) METHOD AND DEVICE FOR PRODUCING A BOREHOLE IN THE SOIL

(75) Inventor: Gerold Schwab, Kernen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 11/892,556

(22) Filed: Aug. 23, 2007

(65) Prior Publication Data

US 2008/0047757 A1 Feb. 28, 2008

(30) Foreign Application Priority Data

Aug. 23, 2006 (EP) ..... 06017593

(51) Int. Cl.
*E21B 10/44* (2006.01)

(52) U.S. Cl. ..... 175/394; 175/323; 405/241

(58) Field of Classification Search ..... 175/403, 175/394, 323, 397; 405/253, 254, 232, 257, 405/249, 248, 243, 240, 241, 242; 299/55, 299/56, 58

See application file for complete search history.

(56) References Cited

U.S. PATENT DOCUMENTS

| | | | | |
|---|---|---|---|---|
| 2,562,841 A | | 7/1951 | Compton | |
| 3,388,949 A | * | 6/1968 | Kozar | 299/87.1 |
| 3,565,190 A | | 2/1971 | Ishii et al. | |
| 3,604,214 A | * | 9/1971 | Turzillo | 405/241 |
| 4,193,462 A | * | 3/1980 | Blaschke et al. | 175/292 |
| 4,949,795 A | * | 8/1990 | McDonald et al. | 175/40 |
| 5,516,237 A | * | 5/1996 | Hebant | 405/233 |
| 6,994,494 B2 | | 2/2006 | Schmidmaier | |
| 2006/0060386 A1 | * | 3/2006 | Reich | 175/323 |

FOREIGN PATENT DOCUMENTS

| | | |
|---|---|---|
| DE | 103 59 103 A1 | 7/2005 |
| FR | 2 832 438 A1 | 5/2003 |
| JP | 08-082186 | 3/1996 |
| JP | 2001-003363 | 1/2001 |

OTHER PUBLICATIONS

Translation of FR2832438 Durmeyer, et al. United States Patent and Trademark Office, Aug. 2007, FLS, Inc.*

* cited by examiner

*Primary Examiner*—David J Bagnell
*Assistant Examiner*—Cathleen R Hutchins
(74) *Attorney, Agent, or Firm*—Jacobson Holman PLLC

(57) ABSTRACT

The invention relates to a method for producing a borehole in the soil, in which a drill pipe and a conveyor screw arranged inside the drill pipe are set into rotation and introduced into the soil, and in which outcropping soil material is loosened by means of at least one main cutting edge, which is positioned axially in front of the conveyor screw, and is conveyed by means of the conveyor screw in the inside of the drill pipe. In accordance with the invention provision is made for the main cutting edge to be arranged on the drill pipe and to be rotated therewith. The invention further relates to a device for producing a borehole in the soil which can be employed in the method according to the invention.

18 Claims, 8 Drawing Sheets

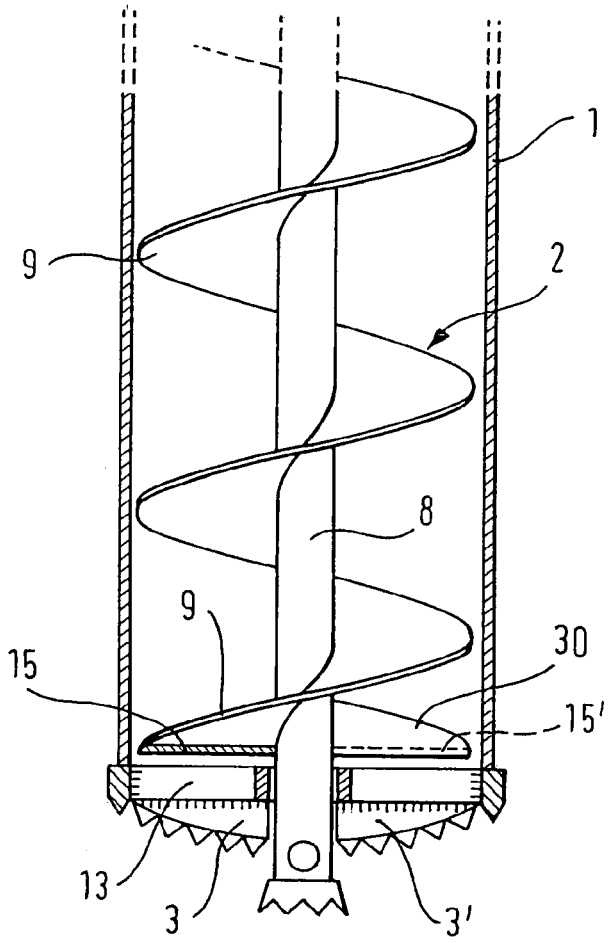
Fig. 5
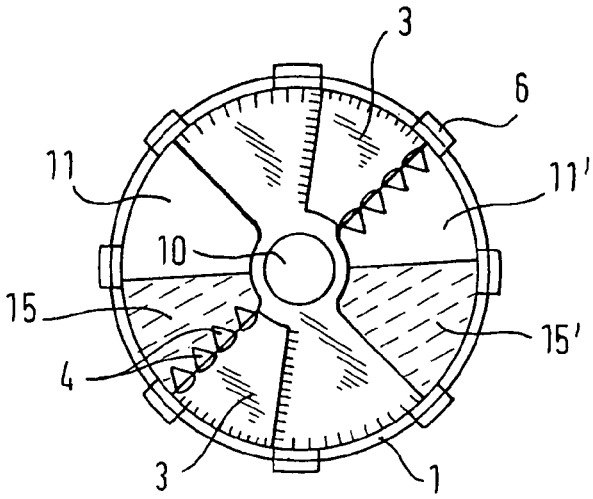

METHOD AND DEVICE FOR PRODUCING A BOREHOLE IN THE SOIL

BACKGROUND OF THE INVENTION

1. Field of the Invention

The invention relates to a method for producing a borehole in the soil. In such a method provision is made in that a drill pipe and a conveyor screw arranged inside the drill pipe are set into rotation and introduced into the soil and in that outcropping soil material is loosened by means of at least one main cutting edge, which is positioned axially in front of the conveyor screw, and is conveyed away by means of the conveyor screw in the inside of the drill pipe.

The invention further relates to a device for producing a borehole in the soil, comprising a drill pipe, a conveyor screw arranged inside the drill pipe and at least one main cutting edge which is positioned axially in front of the conveyor screw for stripping soil material.

The boreholes may serve to produce foundation members and/or pile walls in particular.

2. Related Art

Methods and devices for cased soil drilling, in particular twin-head methods or devices are known. In these methods a drill pipe and a screw that is of the continuous type in particular and located inside the drill pipe, are sunk into the construction site whilst rotating simultaneously. In its end portion the screw has at least one main cutting edge which loosens the soil cropping out in the cross-section of the screw and conveys it to the helical flight of the screw. From the main cutting edge the soil material is conveyed away along the rotating screw in the upward direction. This conveying movement is brought about as a result of frictional effects occurring between the soil material and the surface of the screw flight as well as between the soil material and the inner wall of the drill pipe.

A method of such kind is known for instance from EP 1 394 351 B1 (corresponding to U.S. Pat. No. 6,994,494). It is especially suitable for being applied in unfixed soils, such as gravel and sand, in cohesive mixed soils and/or in soils lying below ground-water level, because in this case the production of an artificial superimposed water-load can be avoided.

However, in twin-head drilling it turned out that under certain circumstances only a comparatively low drilling progress can be attained, which is quite often accompanied by a comparatively high wear occurring on the inner wall of the drill pipe and on the conveyor screw. This effect can be encountered in particular in poorly graduated soil granulations and/or in the case of coarse gravel being existent.

SUMMARY OF THE INVENTION

The object of the invention is to provide a method and a device for producing a borehole in the soil, which can be employed in a great variety of applications whilst ensuring a high drilling progress and being subject to comparatively little wear.

In accordance with the invention the object is solved by a method for producing a borehole in the soil, in which a drill pipe and a conveyor screw arranged inside the drill pipe are set into rotation and introduced into the soil, and in which outcropping soil material is loosened by means of at least one main cutting edge, which is positioned axially in front of the conveyor screw, and is conveyed away by means of the conveyor screw in the inside of the drill pipe, wherein the main cutting edge is arranged on the drill pipe and is rotated therewith; and by a device for producing a borehole in the soil, comprising a drill pipe, a conveyor screw arranged inside the drill pipe and at least one main cutting edge which is positioned axially in front of the conveyor screw for stripping soil material, wherein the main cutting edge is arranged on the drill pipe and can be rotated therewith.

The method according to the invention is characterized in that the main cutting edge is arranged on the drill pipe and is rotated therewith.

The invention takes into account that in drilling methods and drilling devices of the prior art, in which the main cutting edge is arranged on the conveyor screw, the said conveyor screw assumes both the task of loosening the outcropping soil and the task of removing the loosened soil. However, this configuration does not prove to be ideal for all operating conditions. For instance in certain soil geologies the force necessary to loosen the soil may be comparatively high so that the main cutting edge and therefore the conveyor screw can only be rotated at a comparatively low speed. In turn, the low rotational speed can perhaps be too low for a speedy conveying away of the material. In this case the material accumulates in the lower part of the screw. In particular, coarse granules can repeatedly slide downwards and get stuck between the screw and the drill pipe wall. This may result in comparatively high rotational resistance, comparatively high expenditure of force, a comparatively low introduction speed and comparatively high wear.

Compared with this the invention is based on the idea that the conveyor screw is freed at least in part from the task of loosening outcropping soil. Consequently, according to the invention the main cutting edge provided to strip soil material cropping out in the cross-section of the conveyor screw is not arranged on the conveyor screw but provided on the drill pipe in a rotatable manner relative to the conveyor screw. Hence, according to the invention the rotational speed of the conveyor screw and therefore the conveying capacity and the rotational speed of the main cutting edge and therefore the cutting capacity can be varied freely with respect to each other. In particular, even in changing soil geologies the conveying rate of the conveyor screw can be adapted individually to the actual stripping rate of the main cutting edge, so that an undesired accumulation of material in the lower part of the conveyor screw is counteracted effectively. Hence, the wear resulting from such an accumulation of material can be reduced effectively whilst having a good drilling progress. Moreover, the invention renders it possible to react to changing soil geologies in a flexible manner without requiring a complicated rearrangement of the conveyor screw or of other components of the device employed.

In accordance with the invention the rotational speed of the drill pipe determines the rotational speed of the main cutting edge. To this end the main cutting edge can be arranged on the drill pipe in a rotationally fixed manner. It is, for example, also possible to design the main cutting edge, within certain limits, to be rotatable on the drill pipe.

According to the invention it is of advantage that the drill pipe and the conveyor screw are controlled independently of each other with regard to the rotational speed and/or the direction of rotation, whereby a method of particular versatility is provided. For this purpose the drill pipe and the conveyor screw can have separate driving motors for example. However, provision can also be made for at least one common driving motor which drives both the drill pipe and the conveyor screw by means of an adjusting mechanism. The adjusting mechanism, which can be designed as a torque converter in particular, can be e.g. infinitely variable or designed as a gear-shift mechanism.

For a particularly simple construction the main cutting edge can be designed as a cutting edge. However, the main cutting edge can equally be formed by several cutting tools arranged next to one another, such as flat teeth, round shank chisels and/or studs, that can be attached in particular to a tool holder or directly on the drill pipe, in particular they can be screwed on, welded on and/or bolted. By preference, the main cutting edge extends in particular in a radial manner by running from the drill pipe wall towards the drill pipe axis. According to the invention the main cutting edge is arranged and dimensioned in such a manner that when it is rotated about the longitudinal axis of the drill pipe it covers at least a considerable part of the cross-sectional surface of the conveyor screw and preferably of the drill pipe, too. To achieve an especially high cutting capacity whilst having a good distribution of forces at least two main cutting edges are preferably provided in accordance with the invention, which can be arranged in particular symmetrically with respect to the drill pipe axis.

It is of particular advantage that the conveyor screw is rotated at a higher rotational speed than the drill pipe with the main cutting edge. Such an operational mode is especially suitable in the case of coarse gravel being existent. A high rotational speed of the conveyor screw results in the fact that comparatively high centrifugal forces act on the individual soil grains, which can in turn result in the fact that the soil material is conveyed by means of the conveyor screw in a particularly quick and effective manner away from the main cutting edge and in the upward direction. By preference, the rotational speed of the conveyor screw is at least twice as high as the rotational speed of the drill pipe. For instance the rotational speed of the conveyor screw can be up to 10 times the rotational speed of the drill pipe with the main cutting edge. More particularly, the rotational speed of the conveyor screw can lie in the range of 0.5-3 revolutions per second, preferably 1-2 revolutions per second. For best suitability, the drill pipe and the conveyor screw are rotated in opposite directions—but they can also be rotated in the same direction.

Preferably, a continuous conveyor screw is used in accordance with the invention which is suitably longer than the drilling depth planned so that it protrudes from the borehole during the entire drilling operation. By preference, the surrounding drill pipe is also of a greater length than the planned drilling depth. For best suitability, the conveyor screw is rotated continuously during drilling downwards in order to convey away loosened soil material in a continuous manner towards the soil surface.

Furthermore, according to the invention it is of advantage that a filling material is introduced into the borehole via a core pipe of the conveyor screw so as to produce a foundation member and/or a wall member. Once a final depth has been reached, the drill pipe and the conveyor screw are preferably retracted simultaneously and in doing so the filling material, which preferably includes concrete, is introduced via the core pipe into the developing cavity.

The device in accordance with the invention is characterized in that the main cutting edge is arranged on the drill pipe and can be rotated therewith.

The device according to the invention can be employed in particular for carrying out the method according to the invention, whereby the advantages set out in this connection can be achieved. The aspects of the invention described in connection with the method according to the invention can also be applied to the device according to the invention, just as the aspects described in connection with the device can be applied to the method.

According to the invention the conveyor screw is provided with at least one helical flight. Since provision is made according to the invention for the soil material cropping out in the cross-section of the conveyor screw, and in particular in the cross-section of the helical flight, to be loosened at least in part by the main cutting edge located on the drill pipe there is no need for a loosening tool to be provided on the helical flight. The helical flight merely serves for the transport and, for best suitability, only makes contact with soil material when this has already been loosened by the main cutting edge. By preference, the helical flight is offset backwards with respect to the front face of the drill pipe towards the inside of latter.

In principle, according to the invention provision can be made for the conveyor screw to be freed from any cutting function and to provide the at least one main cutting edge in such a way that it covers the entire cross-section of the conveyor screw during rotation. However, it may also be of advantage that at least one centering cutting edge is provided on the conveyor screw, which projects from the main cutting edge in particular in the axial direction. In such case the conveyor screw also has a certain cutting function through the centering cutting edge in the cross-section of the conveyor screw in addition to the main cutting edge. Preferably, the centering cutting edge is arranged on the conveyor screw in a rotationally fixed manner. For best suitability, the cutting surface moved over by the centering cutting edge during a rotation of the conveyor screw is smaller than the cutting surface moved over by the main cutting edge during a rotation of the drill pipe. The centering cutting edge can have several teeth for example.

Furthermore, it is of advantage that at least one further cutting tool is arranged at the front face of the drill pipe on the circumference thereof. In addition to the main cutting edge an annular cutting edge can be formed at the front face of the drill pipe, which loosens soil material cropping out on the drill pipe shell and facilitates an axial sinking of the drill pipe. The further cutting tool can be designed as a tooth in particular.

A device having an especially simple construction is provided in that in an end portion of the drill pipe, more particularly in the pipe cross-section, a tool holder is arranged on which the main cutting edge is arranged. The tool holder can include e.g. a plate that closes the drill pipe at its front face. The tool holder can also be offset backwards with respect to the front face of the drill pipe towards the inside of the pipe or it can protrude from the drill pipe. For best suitability, at least one opening is provided on the tool holder for the passage of stripped soil material into the inside of the drill pipe.

Moreover, according to the invention it is of advantage that at least one closing member is provided to close the opening. Through this it is possible to close the opening during the retraction of the drill pipe so that stripped soil material located in the drill pipe cannot fall back into the borehole again. By preference, the closing member is provided in a rotatable manner relative to the drill pipe and the opening about the longitudinal axis of the drill pipe.

The closing member can be connected to the conveyor screw in a rotationally fixed manner for example. In such case, through rotation of the conveyor screw relative to the drill pipe the opening can be opened and closed again. However, it is also possible for the closing member to be connected to the main cutting edge in a rotationally fixed manner.

To achieve a particularly simple construction it is of advantage that the main cutting edge is arranged in a rotationally fixed manner on the drill pipe. Provision can also be made for the main cutting edge to be rotatable relative to the drill pipe and for limiting means, in particular stops but also locking bolts or locking pawls that can be actuated mechanically and/or hydraulically or the like, to be provided that limit an angle of rotation of the main cutting edge relative to the drill pipe. According to this embodiment the main cutting edge is able to move with respect to the drill pipe within a certain predetermined angular range. The main cutting edge will only be taken along by the rotating drill pipe when it has abutted directly or indirectly against one or more stops on the drill pipe. For actuation of the locking bolts, locking pawls or other locking devices driving means can be provided.

This embodiment is especially advantageous if the main cutting edge and the closing member are connected in a rotationally fixed manner. In such case the opening can be made free or closed through rotation of the main cutting edge together with the closing member relative to the drill pipe. In particular, for this purpose the main cutting edge can be placed on the outcropping soil and the drill pipe can be rotated to a certain extent, and in doing so the main cutting edge remains with the closing member on the ground on account of the friction. By preference, the stops are arranged such that when the drill pipe is rotated in the cutting direction of the main cutting edge they hold the closing member in a release position in which the opening is made free and in the case of a rotation contrary to the cutting direction they hold the closing member in a closing position, in which it covers the opening. For the same purpose the limiting means can include bolts, pawls and/or locks in addition or alternatively to the stops.

Another advantageous improvement of the invention resides in the fact that the main cutting edge is arranged on a holding plate, in particular on a helical flight, extending in an oblique manner to the longitudinal axis of the drill pipe. Due to its oblique position the holding plate, which can also be referred to as cutting strip or conveyor plate, is able, during rotation of drill pipe and main cutting edge, to convey soil material stripped by the main cutting edge in the axial direction towards the inside of the pipe and towards the conveyor screw which takes over the further transport of the soil material. Preferably, the holding plate is arranged such that it includes an angle ranging between 10° and 80° together with the borehole bottom and/or the horizontal extending perpendicularly to the longitudinal axis of the drill pipe. If the main cutting edge is provided on a helical flight, the main cutting edge can be formed helically. It can also be formed e.g. at the end of the helical flight in a substantially radial manner to the longitudinal axis of the drill pipe. Preferably, the helical flight is formed as a progressive flight having a decreasing external diameter towards to the tip of the helical flight and/or an increasing pitch towards the tip of the helical flight. In this case the main cutting edge can form a helix with a varying diameter. More particularly, the main cutting edge can be designed such that it moves over a conical or otherwise convex surface during rotation.

For a particularly efficient transport of material from the main cutting edge through the opening of the tool holder into the inside of the pipe and towards the conveyor screw it is of advantage that the holding plate is arranged on the tool holder in the area of the opening and preferably includes an acute angle with the front face of the opening. In this case the holding plate can convey soil material through the opening during rotation.

Another advantageous embodiment of the invention resides in the fact that the conveyor screw has a core pipe for introducing a filling material into the borehole and that on the core pipe at least one outlet opening for the filling material is provided. By preference, the core pipe protrudes axially from the drill pipe on the front face of the drill pipe provided with the main cutting edge. In this, the outlet opening is ideally offset outwards in the axial direction with respect to the drill pipe. However, the outlet opening for the filling material can also be located in parts of the core pipe that lie inside the drill pipe. In this case the filling material can pass through an opening in the core pipe and/or in the tool holder, which is identified e.g. by reference number 11 in the Figures and which may also serve for the passage of stripped soil material towards the inside of the pipe in particular, from the inside of the pipe towards the outside. The outlet opening can be provided on the side and/or at the front face of the core pipe for example. Preferably, a centering cutting edge is attached to the front face of the core pipe.

An especially high quality of the foundation member and/or wall member developing during the filling of the borehole can be attained in that a closing device is provided for closing the outlet opening. The closing device is preferably designed such that the outlet opening can be closed by placing the core pipe onto the bottom of the borehole. The closing device can include e.g. a piston arranged in an axially movable manner inside the core pipe, which is formed at its front face with a contact surface for outcropping soil. During drilling this piston is suitably pushed by outcropping soil material into the core pipe, whereby an outlet opening arranged laterally on the core pipe can be closed. However, when the conveyor screw is retracted the piston can move axially out of the core pipe due to the effect of pressure or gravity or by means of a resetting device and therefore make the outlet opening free. Instead of a piston arranged inside the core pipe the closing device can also have a sleeve that is movable axially on the outside of the core pipe.

A device of particular reliability is achieved in that the conveyor screw is rotatably supported on the drill pipe in the end portion of the drill pipe. For example a pivot bearing can be provided on the tool holder of the drill pipe, wherein the core pipe of the conveyor screw is accommodated. The end portion can in particular be understood as the portion facing towards the soil, on which the cutting edges are arranged. As a result of the support of the conveyor screw at the end of the soil pipe the conveyor screw is centered in the soil pipe, so that it is possible to operate with especially long conveyor screws without running the risk of the conveyor screw making undesirable contact with the inner wall of the drill pipe.

According to a further preferred embodiment the main cutting edge has a collar cutting portion that suitably extends at least by approximation in a curved manner around the pipe axis. Such a collar cutting portion can facilitate the penetration of the drill pipe into the soil and improve the smooth running.

BRIEF DESCRIPTION OF THE DRAWINGS

The invention will be described in the following by way of preferred embodiments that are shown schematically in the Figures, wherein:

FIG. 5 shows a partially sectional side view (top) and a bottom view (bottom) of a further embodiment of a device according to the invention;

In FIGS. 6 to 14 the conveyor screw is not shown for the sake of clarity. Elements having the same effect are designated throughout the Figures with the same reference signs.

DETAILED DESCRIPTION OF THE PREFERRED EMBODIMENTS

Figure 1:
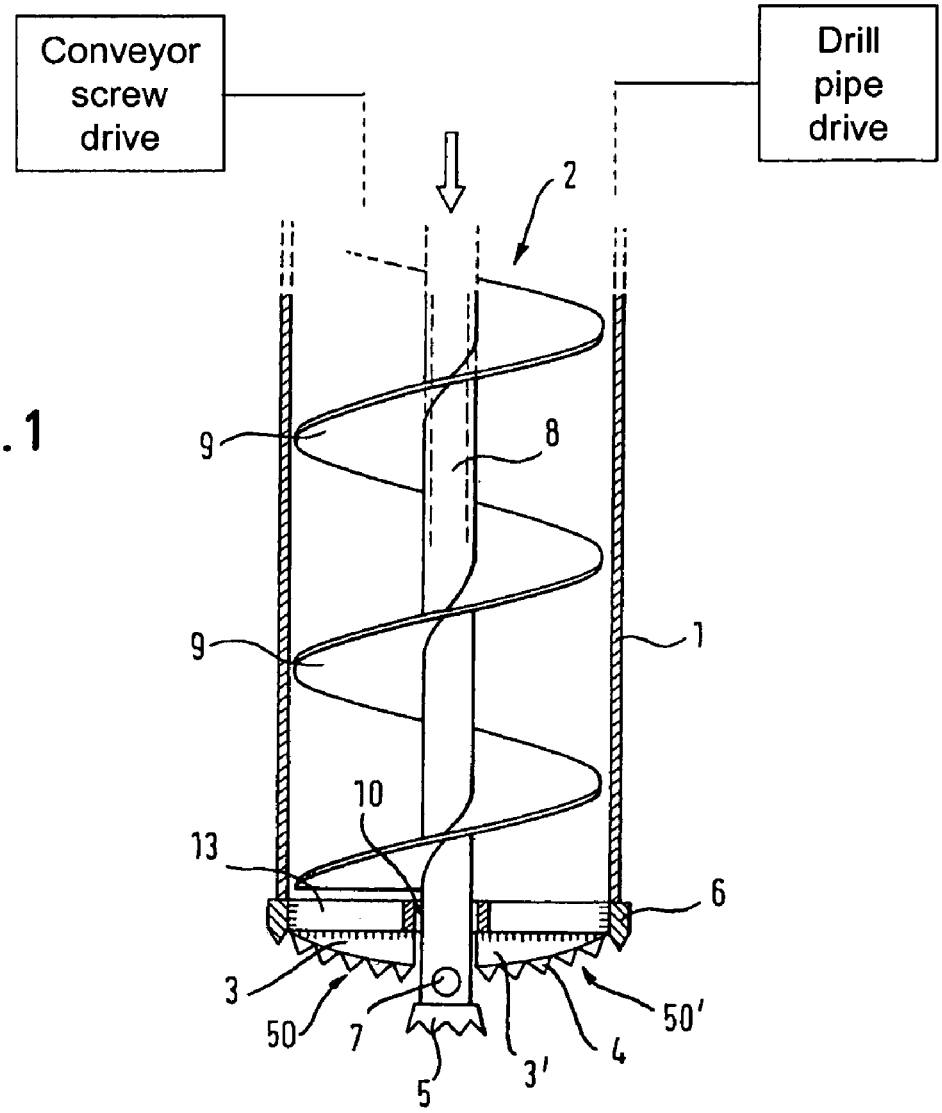
FIG. 1 shows a partially sectional side view of a first embodiment of a device according to the invention.
Figure 2:
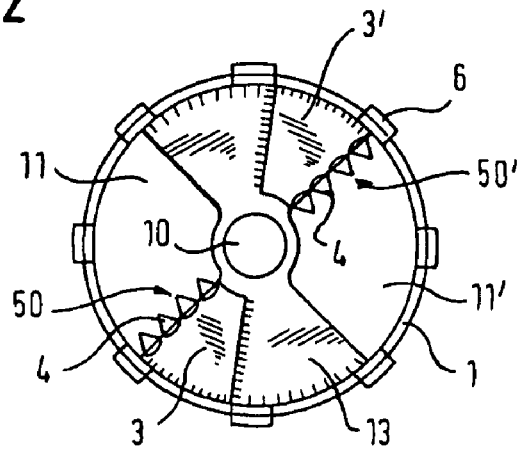
FIG. 2 shows a view of the device of FIG. 1 from the underside.

A first embodiment of a device according to the invention for producing a borehole in the soil is shown in FIGS. 1 and 2. The device includes a rotatably driven drill pipe 1, in which a conveyor screw 2 is arranged coaxially. The conveyor screw 2 has a core pipe 8, on the outside of which a helical flight 9 extends longitudinally.

At the end of the drill pipe 1 that faces towards the borehole a tool holder 13 designed as a cover plate is provided that covers the drill pipe 1 to some extent. The tool holder 13 extends in sections from the wall of the drill pipe 1 in the radial direction towards the longitudinal axis of the drill pipe 1. In the tool holder 13, two openings 11, 11' in the shape of a circular sector are formed that permit a transport of material through the tool holder 13 towards the inside of the drill pipe and towards the conveying portion of the conveyor screw 2.

Lying diametrically opposite with respect to the longitudinal axis of the drill pipe 1, two obliquely extending holding plates 3, 3' are arranged on the front face of the tool holder 13 that faces away from the pipe. On these holding plates 3, 3' a plurality of teeth 4 is provided that form a main cutting edge 50, 50' each. The teeth can include e.g. flat teeth, round shank chisels and/or bars. More particularly, they can have a tungsten carbide tip.

Through the holding plates 3, 3' and the tool holder 13 the two main cutting edges 50, 50' are connected in a rotationally fixed manner with the drill pipe 1. Since they are arranged at the front face with respect to the conveyor screw 2, the main cutting edges 50, 50' are able to loosen soil material cropping out in the conveying cross-section of the conveyor screw 2 on rotation of the drill pipe 1. The loosened soil material is grasped by the holding plates 3, 3' that extend obliquely to the horizontal and, on further rotation of the drill pipe 1, the material is conveyed through the openings 11, 11' into the conveying portion of the conveyor screw 2. To ensure that the loosened soil material is grasped by the helical flight 9 in an especially reliable manner, it may be useful to design the helical flight 9 in its intake portion at the end with smooth, in particular radially and/or horizontally extending edges.

In the tool holder 13 a recess 10 is provided centrally with respect to the drill pipe 1, through which the core pipe 8 of the conveyor screw 2 projects. In this recess 10 the conveyor screw 2 is rotatably supported by means of its core pipe 8 on the drill pipe 1, for which purpose e.g. a friction bearing or a roller bearing may be provided on the recess 10. A centering cutting edge 5 is arranged at the front face of the core pipe end 8 that projects through the recess 10. This centering cutting edge 5 protrudes axially from the main cutting edges 50, 50' and is in a rotationally fixed connection with the conveyor screw 2. By means of the centering cutting edge 5 which, together with the core pipe 8 are, for reasons of clarity, not depicted in FIG. 2, soil material cropping out in the cross-section of the core pipe 8 can be loosened through rotation of the conveyor screw 2.

In the end portion of the core pipe 8 that protrudes from the tool holder 13 an outlet opening 7 is provided laterally in the pipe wall. Additionally or alternatively an outlet opening can also be provided at the end of the core pipe 8. On retraction of the conveyor screw 2 and the drill pipe 1 a filling material can be introduced via the core pipe 8 into the developing cavity, in which case the filling material leaves the core pipe 8 through the outlet opening 7. In another embodiment the filling material can be introduced through the recess 10 into the developing cavity.

At the front face of the drill pipe, on the pipe shell, further cutting tools 6 designed as teeth are arranged. They form an annular cutting edge that strips soil material cropping out below the drill pipe 1. The cutting tools 6 can also be designed as bars or chisels.

Figure 3:
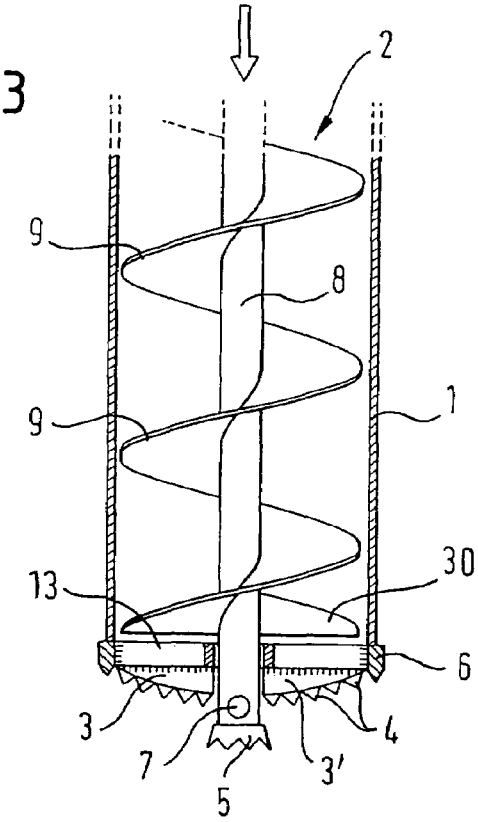
FIG. 3 shows a partially sectional side view of a further embodiment of a device according to the invention.

Another embodiment of a device in accordance with the invention is shown in FIG. 3. The embodiment depicted in FIG. 3 mainly differs from the embodiment of FIGS. 1 and 2 in that, in addition to the continuous helical flight 9, a second helical flight 30 is arranged in the lower part of the conveyor screw 2.

Figure 4:
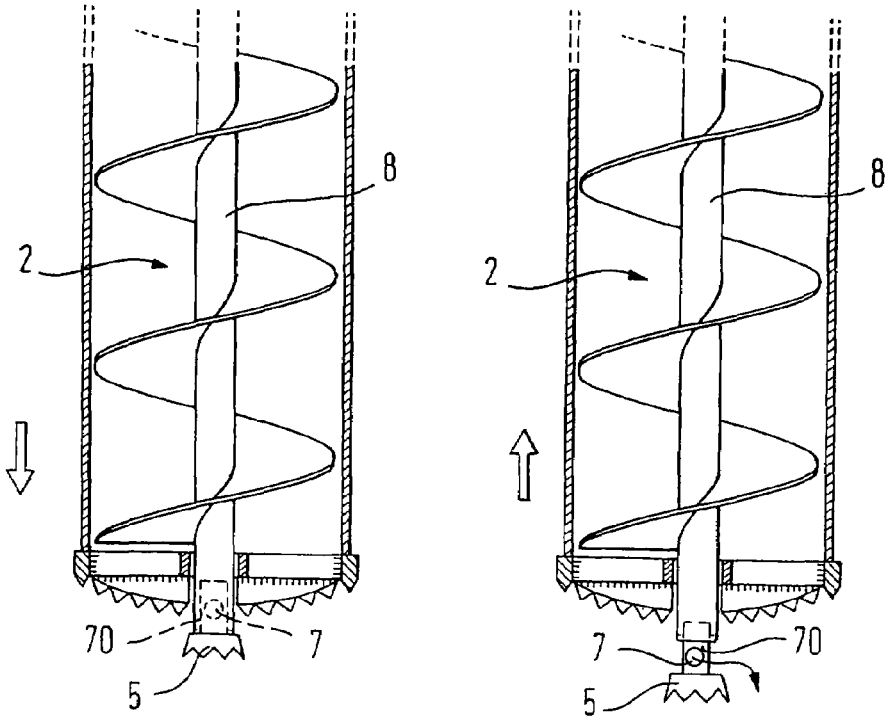
FIG. 4 shows partially sectional side views of a further embodiment of a device according to the invention in various operating conditions.

A further embodiment of a device according to the invention is shown in FIG. 4 in two operating conditions. The illustration on the left shows the condition during the drilling of the device, while the illustration on the right shows the condition during the retraction of the device.

According to the embodiment of FIG. 4 the core pipe 8 has at its end a sleeve-like piston 70, which is supported in an axially movable manner inside the adjoining core pipe portion. The outlet opening 7 is provided on the side wall of the piston 70. At the front face of the piston 70 the centering cutting edge 5 is arranged.

During the drilling process illustrated on the left in FIG. 4 the conveyor screw 2 is pressed together with the core pipe 8 in the axial direction against the outcropping soil. The resultant reactive forces hold the centering cutting edge 5 resting on the soil and the piston 70 in an upper position, in which the piston 70 is slid into the adjoining core pipe portion and in which the outlet opening 7 formed on the piston 70 is located opposite the wall of the adjoining core pipe portion and is therefore closed. In doing so, the risk of soil material entering inside the core pipe 8 and blocking it can be reduced.

In the retraction process shown on the right in FIG. 4 the piston 70 is lifted with the centering cutting edge 5 from the soil. Therefore, the piston 70 can be moved out of the core pipe 8, which can be brought about e.g. through the effect of gravity, through a spring-actuated resetting device and/or through the application of pressure on the interior of the core pipe 8. The axial movement of the piston 70 out of the core pipe 8 can be limited for example by a stop. In the extended condition of the piston 70 shown on the right in FIG. 4 the outlet opening 7 is offset axially with respect to the wall of the adjoining core pipe portion and is therefore made free so that filling material can pass out of the core pipe 8 and into the vicinity surrounding it.

Another embodiment of a device in accordance with the invention is depicted in FIG. 5. In contrast to the embodiment of FIG. 1 the embodiment according to FIG. 5 provides for closing members 15, 15' in order to close the openings 11, 11' of the tool holder 13. The closing members 15, 15' are connected in a rotationally fixed manner to the conveyor screw 2. By turning the conveyor screw 2 relative to the drill pipe 1 the closing members 15, 15' can be moved between a closed position, in which they cover the openings 11, 11', and an open position, in which they are arranged in a laterally offset manner with respect to the openings 11, 11' so that they are made free. FIG. 5 shows the closing members 15, 15' in an intermediate position in which they cover the openings 11, 11' only in part. According to the embodiment of FIG. 5 the closing members 15, 15' are designed as radially extending plates that are arranged at their ends on the two helical flights 9 and 30, respectively.

For best suitability, the openings 11, 11' are closed during the retraction of the drill pipe 1 so that soil material present in the drill pipe 1 is prevented from falling downwards into the developing cavity and/or filling material, e.g. concrete, emerging from the core pipe 8 is prevented from entering into the drill pipe 1. In this way prevention can be made in particular that soil material from the drill pipe 1 can reach introduced filling material, where it might lead to undesired inhomogeneity. The closing of the openings 11, 11' during the retraction can be of particular advantage during drilling in unfixed soils. For instance provision can be made in that the closing members 15, 15' are first brought into the closed position through a rotation of the conveyor screw 2 relative to the drill pipe 1 and that afterwards the conveyor screw 2 and the drill pipe 1 are retracted without any further rotation occurring. However, during retraction it is also possible to rotate the drill pipe 1 and the conveyor screw 2 at the same rotational speed and in the same direction of rotation, whereby the closing members 15, 15' remain in the closed position.

Figure 6:
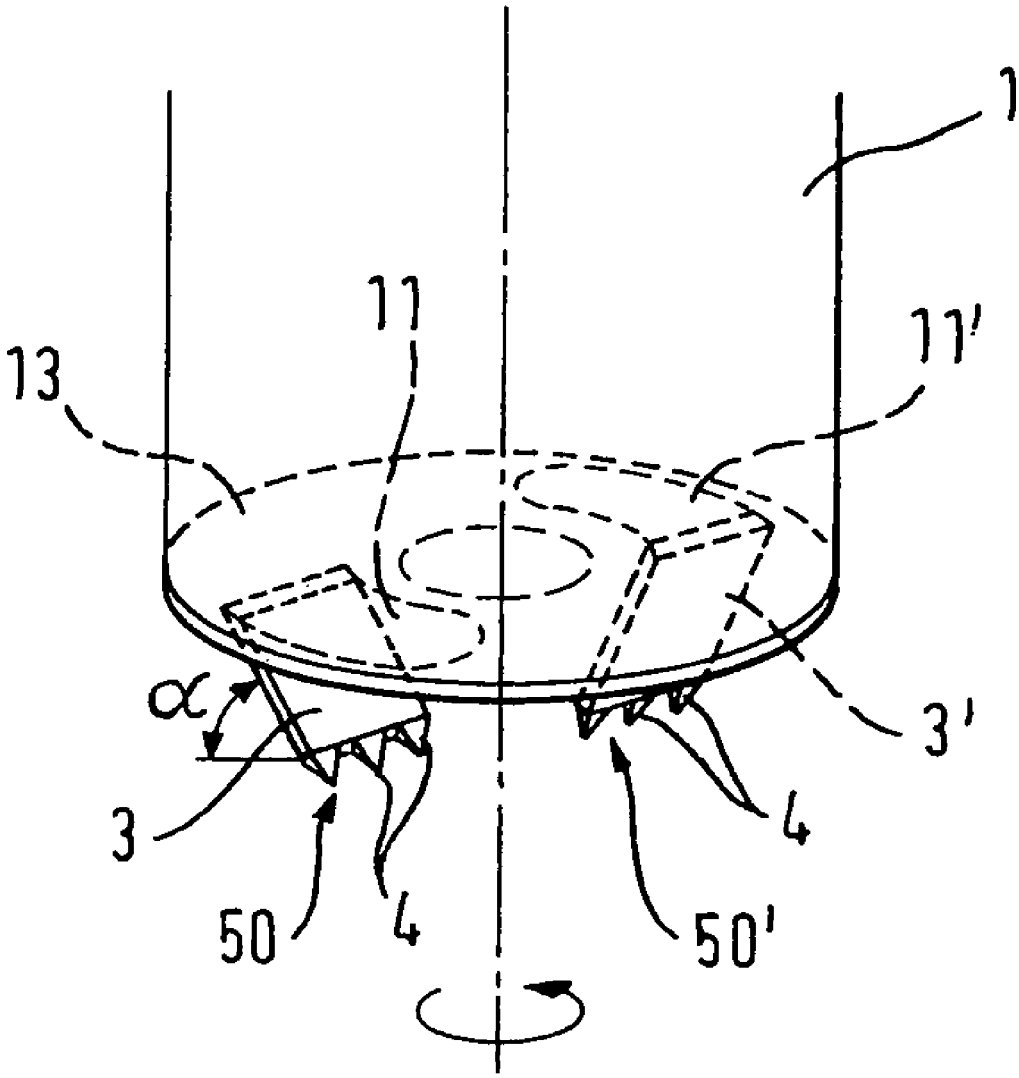
FIG. 6 shows a perspective view of a further embodiment of a device according to the invention.

A further embodiment of a device according to the invention is illustrated in FIG. 6. This Figure shows an advantageous arrangement of the holding plates 3, 3' on the tool holder 13.

According to the embodiment of FIG. 6 the holding plates 3, 3' are provided directly at the openings 11, 11' on the tool holder 13 such that during rotation they convey stripped soil material in the axial direction towards the drill pipe 1 and through the openings 11, 11'. For this purpose the holding plates 3, 3' suitably include an acute angle together with the front faces of the adjoining openings 11, 11'.

Together with the outcropping soil the holding plates 3, 3' include an angle of inclination a that suitably ranges between 10 and 80° depending on the soil type. By means of this angle $\alpha$ determination is made if the soil is peeled away or if it is predominantly loosened through pressing in and agitation.

Figure 7:
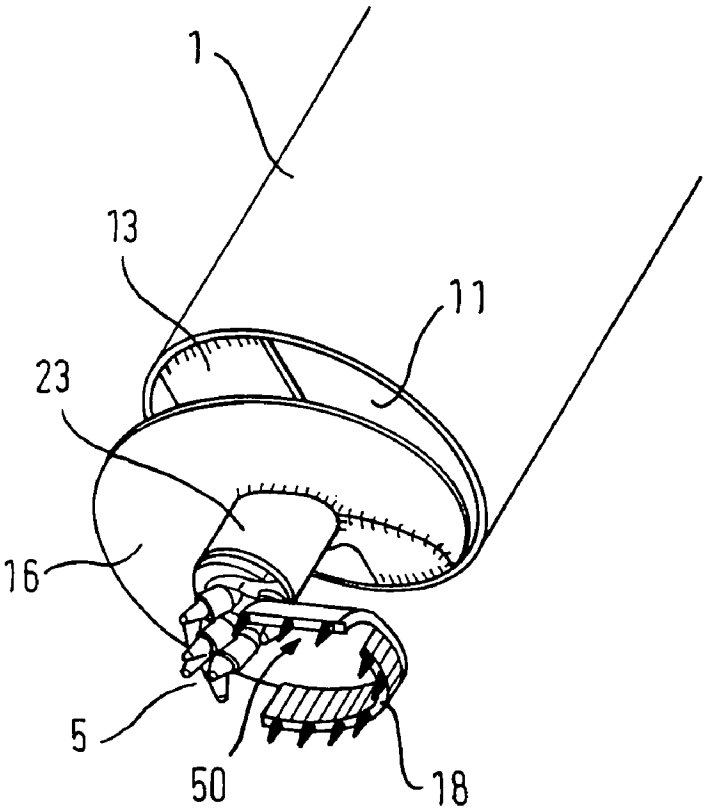

Another embodiment of a device according to the invention can be taken from FIG. 7. According to the embodiment of FIG. 7 the main cutting edge 50 is arranged at the end of a helical flight 16 that is connected through the tool holder 13 in a rotationally fixed manner to the drill pipe 1. The helical flight 16 ensures a particularly reliable transport of stripped soil material into the drill pipe 1 towards the conveyor screw.

In addition to an approximately radially extending cutting edge portion the main cutting edge 50 of the embodiment of FIG. 7 also includes a collar cutting edge portion 18 that extends about the longitudinal axis of the drill pipe 1. Both in the radially extending cutting edge portion and in the collar cutting edge portion 18 individual teeth are arranged on the main cutting edge 50.

The helical flight 16 runs around a pipe stub 23 that protrudes axially from the tool holder 13. The pipe stub 23 can serve e.g. as a bearing sleeve for the core pipe of the conveyor screw not depicted in FIG. 7. At the front face of the pipe stub 23 a centering cutting edge 5 is located which, in the illustrated embodiment, is preferably arranged on the core pipe in a rotatable manner with respect to the pipe stub 23. In principle, the centering cutting edge 5 can also be provided in a rotationally fixed manner on the pipe stub 23, in which case it constitutes a further main cutting edge. The centering cutting edge 5 is formed by several teeth.

Figure 8:
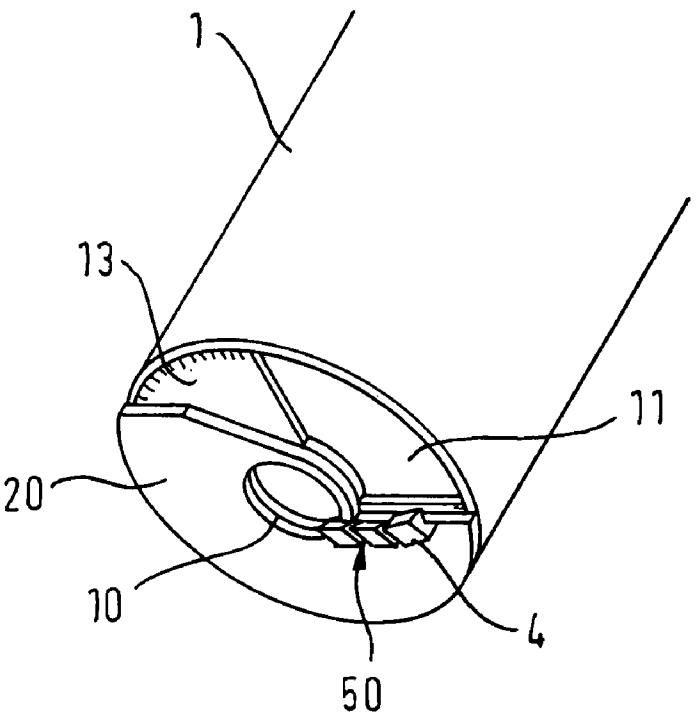

Another embodiment of a device in accordance with the invention is shown is FIG. 8. The device of FIG. 8 includes a closing member 20, with which the opening 11 in the tool holder 13 can be covered. The closing member 20 is designed as a cover plate that is arranged on the side of the tool holder 13 facing away from the interior of the drill pipe. Through a roller bearing or a friction bearing for example the closing member 20 is supported on the tool holder 13 in a rotatable manner relative to the drill pipe 1. The main cutting edge 50 is provided in a fixed manner on the rotatable closing member 20.

To close the opening 11 the drill pipe 1 is driven into the soil so that the main cutting edge 50 engages in the outcropping soil. Then the drill pipe 1 is rotated. However, due to the engagement of the main cutting edge 50 in the outcropping soil and the resultant friction the rotation is not repeated by the closing member 20 so that a relative movement between the closing member 20 and the drill pipe 1 with its opening 11 takes place. This movement can be maintained up until the opening 11 is covered or made free by the closing member 20 as desired.

In order to couple the rotatably supported main cutting edge 50 in a fixed manner with the drill pipe 1 for a drilling operation, locking means are provided in the embodiment of FIG. 8 that are not depicted here and can be opened or closed in a remote-controlled fashion from the ground surface in particular. The locking means can include pawls and/or bolts for example.

The closing member 20 is formed as a plate in the shape of a circular sector that has a planar design on the side facing towards the interior of the drill pipe 1. The opposite lying front face of the tool holder 13 that faces away from the pipe is also designed in a planar fashion. As a result, it can be ensured that during the operation of the closing member 20 comparatively little soil material can get between the closing member 20 and the tool holder 13, for which reason the risk of jamming and of wear and tear is reduced.

In the embodiment of FIG. 8 the teeth 4 constituting the main cutting edge 50 are arranged in an oblique fashion directly on the cover-like closing member 20.

The recess 10 for the passage of the core pipe 8 not depicted in FIG. 8 extends through the tool holder 13 and the closing member 20 arranged thereon in a rotatable manner. The recess makes it possible that, even when the opening 11 is closed, filling material is introduced from the front face of the drill pipe 1 into the cavity developing during retraction.

Figure 9:
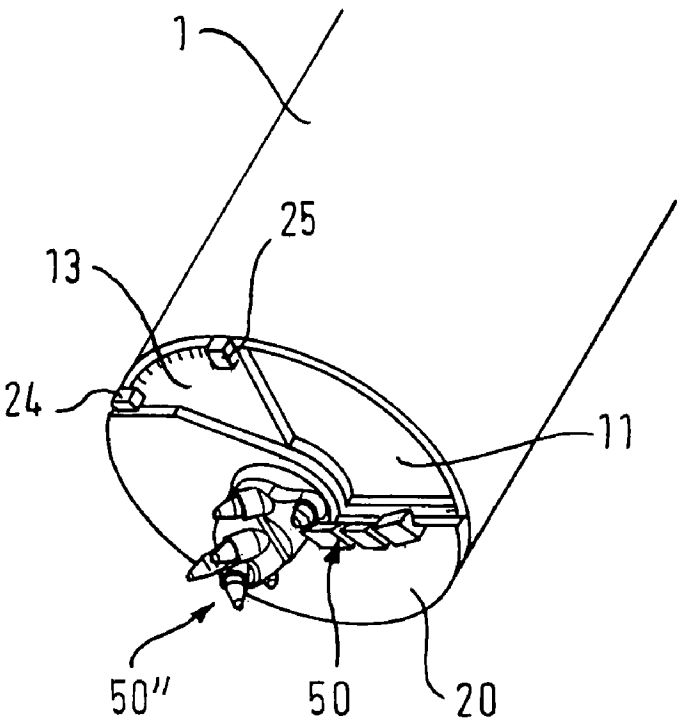

A further embodiment of a device according to the invention is illustrated in FIG. 9. Just as in the embodiment of FIG. 8, in the embodiment of FIG. 9 a closing member 20 designed as a cover is provided at the front face of the tool holder 13 which is rotatable relative to the tool holder 13 and the drill pipe 1 and on which the main cutting edge 50 is arranged. In the embodiment of FIG. 9 stops 24, 25 are additionally provided on the tool holder 13 that limit the angle of rotation of the closing member 20 relative to the tool holder 13 and the drill pipe 1.

In the embodiment of FIG. 9 the opening and closing of the opening 11 through the closing member 20 is likewise brought about through a rotation of the drill pipe 1, in which case the closing member 20 does not follow suit with this rotation due to the friction with the surrounding soil and therefore a relative movement between the closing member 20 and the opening 11 takes place. However, due to the stops 24, 25 a rotation of the closing member 20 with the main cutting edge 50 relative to the drill pipe 1 is possible in a limited angular range only. If the angular range is surpassed, the closing member 20 abuts against one of the stops 24, 25 and is taken along by the drill pipe 1. The main cutting edge 50 then follows the rotation of the drill pipe 1 and can strip off outcropping soil material. The stops 24, 25 are arranged such that, on rotation of the drill pipe 1 in the cutting direction of the main cutting edge 50, they hold the closing member in an open position in which the opening 11 is made free and on rotation contrary to the cutting direction of the main cutting edge 50, the stops hold the said closing member in a closed position in which the opening 11 is covered by the closing member 20.

In the illustrated embodiment the stops 24, 25 are provided on the tool holder 13. Additionally or alternatively stops can be arranged on the drill pipe 1 and/or on the closing member 20.

Figure 10:
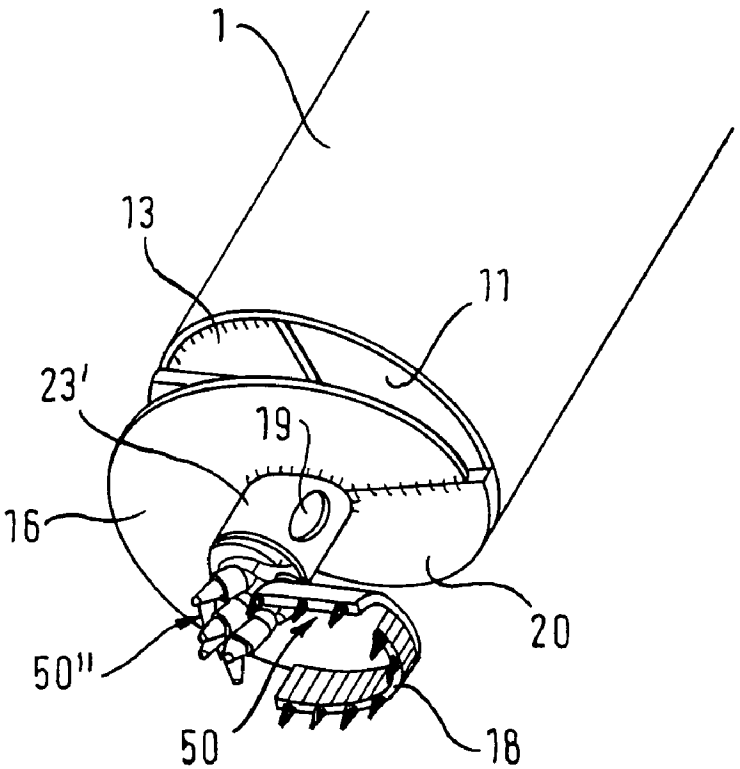
FIGS. 7 to 14 show perspective views of further embodiments of devices according to the invention.

A further embodiment of a device according to the invention with a closing member 20 for covering the opening 11 is shown in FIG. 10. In contrast to the embodiments of FIGS. 8 and 9 the main cutting edge 50 is not formed directly on the plate-shaped closing member 20 in the embodiment of FIG. 10. Here a helical flight 16 is provided on the closing member 20 in a rotationally fixed manner, at the end of which the main cutting edge 50 is formed. The helical flight 16 and the main cutting edge 50 are designed in analogy to the embodiment of FIG. 7. A limitation of the angle of rotation of the closing member 20 can be effected through locking means not depicted here and/or through stops not depicted here either.

Just as in the embodiment of FIG. 7, a pipe stub 23' is provided in the embodiment of FIG. 10 at the front face of the device, around which the helical flight 16 extends. In the embodiment of FIG. 10 the pipe stub 23' is arranged on the closing member 20. In the interior of the pipe stub 23' the core pipe of the conveyor screw, not depicted here, is supported. Laterally on the pipe stub 23' an outlet opening 19 is provided to discharge filling material from the core pipe. The outlet opening 19 can suitably be opened or closed in that the core pipe, which protrudes into the pipe stub 23', is moved axially with respect to the drill pipe 1 and therefore the pipe stub 23'.

At the front face of the pipe stub 23' a pilot cutting edge 50" is arranged in the illustrated embodiment which equally forms a main cutting edge.

Figure 12:
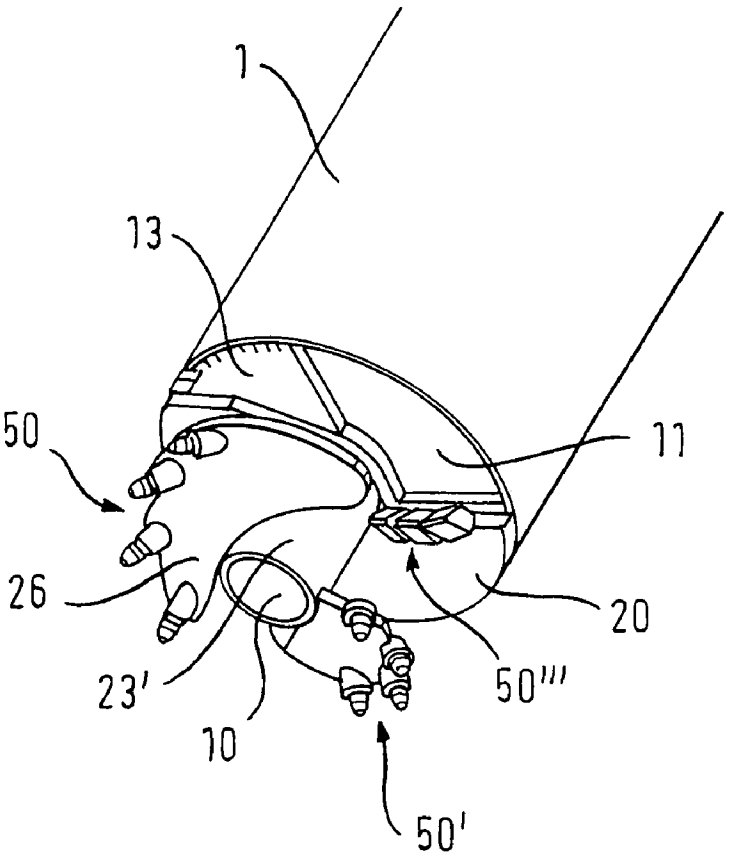
Figure 11:
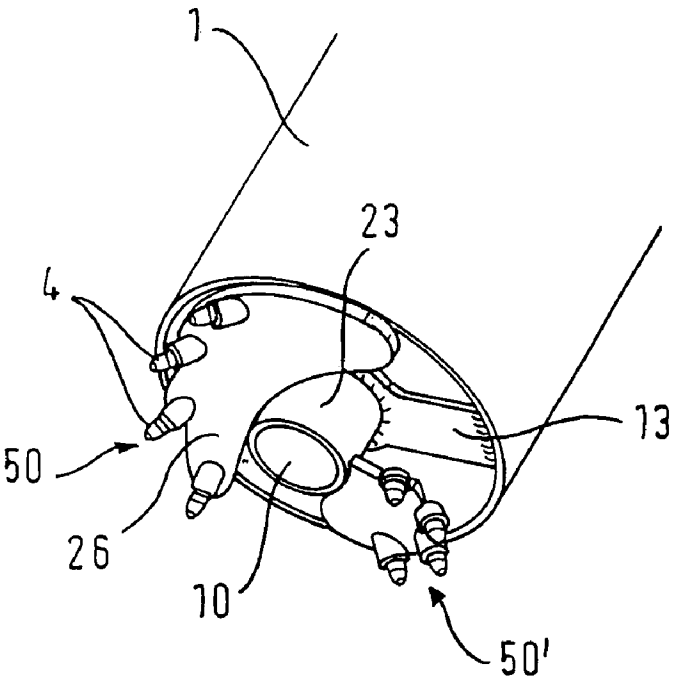
Figure 13:
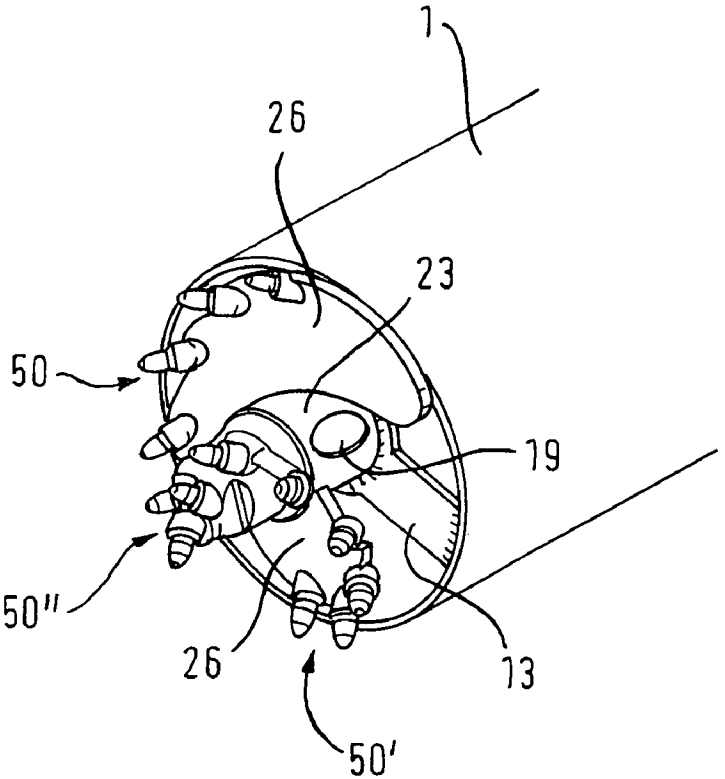

FIGS. 11 to 13 show further embodiments of devices according to the invention, in which two spiral-shaped main cutting edges 50, 50' designed as progressive cutting edges are provided each. The progressive edges 50, 50' are constituted by teeth 4 arranged along a progressive helical flight 26.

In the embodiment of FIG. 12 a closing member 20 for closing the opening 11 is provided that can be rotated relative to the drill pipe 1. On this closing member 20 an additional linear-shaped main cutting edge 50'" is arranged on the edge of a passage opening.

In the embodiment of FIG. 13 an additional main cutting edge 50" formed as a pilot cutting edge is arranged in the centre axis of the helical flight 26 and the drill pipe 1.

Figure 14:
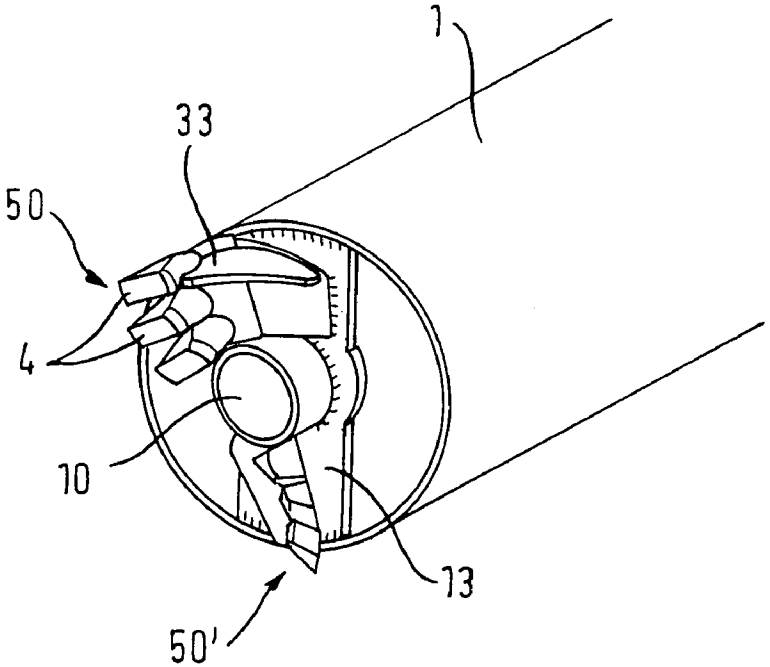

Another embodiment of a device according to the invention is shown in FIG. 14. In this embodiment the main cutting edges 50, 50' are formed on obliquely positioned plates 33.

The invention claimed is:

1. A device for producing a borehole in the soil, comprising:

a drill pipe having a drill pipe wall and a drill pipe axis, a conveyor screw arranged inside the drill pipe and having a cross-sectional surface, and at least one main cutting edge arranged on the drill pipe for rotation therewith around the drill pipe axis and positioned axially in front of the conveyor screw for stripping soil material, the at least one main cutting edge extending from the drill pipe wall towards the drill pipe axis, so that the main cutting edge covers at least a considerable part of the cross-sectional surface of the conveyor screw when the at least one main cutting edge is rotated about the drill pipe axis.

2. A method for producing a borehole in the soil using the device of claim 1, comprising the steps of:

setting the drill pipe and the conveyor screw into rotation and introducing them into the soil, rotating the at least one main cutting edge together with the drill pipe around the drill pipe axis, loosening outcropping soil material using the at least one main cutting edge, and conveying away the loosened outcropping soil material by means of the conveyor screw.

3. The method according to claim 2, wherein in the setting step, the drill pipe and the conveyor screw are controlled independently of each other with regard to the rotational speed and/or the direction of rotation.

4. The method according to claim 2, wherein the conveyor screw is rotated at a higher rotational speed than the drill pipe with the main cutting edge.

5. The device according to claim 4, wherein, the rotational speed of the conveyor screw lies in the range of 0.5-3 revolutions per second.

6. The method according to claim 2, wherein the conveyor screw includes a core pipe, and the method comprises the further step of introducing a filling material into the borehole via the core pipe in order to produce a foundation member.

7. The device according to claim 1, wherein on the conveyor screw at least one centering cutting edge is provided which projects from the at least one main cutting edge and/or at least one further cutting tool is arranged at the front face of the drill pipe on the circumference thereof.

8. The device according to claim 7, wherein the at least one centering cutting edge projects from the at least one main cutting edge in the axial direction.

9. The device according to claim 1, wherein in an end portion of the drill pipe a tool holder is arranged, on which the main cutting edge is arranged.

10. The device according to claim 9, wherein at least one opening is provided on the tool holder for the passage of stripped soil material into the inside of the drill pipe.

11. The device according to claim 10, wherein at least one closing member is provided for closing the opening, which is connected in a rotationally fixed manner with the conveyor screw or the main cutting edge.

12. The device according to claim 1, wherein the main cutting edge is rotatable relative to the drill pipe and wherein the device further comprises limiting means for limiting an angle of rotation of the main cutting edge relative to the drill pipe.

13. The device according to claim 12, wherein the limiting means comprises at least one of one of stops, locking bolts, and locking pawls.

14. The device according to claim 1, further comprising a holding plate extending in an oblique manner to the longitudinal axis of the drill pipe, and wherein the main cutting edge is arranged on the holding plate.

15. The device according to claim 14, wherein at least one opening is provided on the tool holder for the passage of stripped soil material into the inside of the drill pipe the holding plate is arranged on the tool holder in the area of the opening and includes an acute angle with the front face of the opening.

16. The device according to claim 14, wherein the holding plate is arranged on a helical flight.

17. The device according to claim 1, wherein the conveyor screw includes a core pipe for introducing a filling material into the borehole, on the core pipe at least one outlet opening for the filling material is provided and a closing device is provided for closing the outlet opening.

18. The device according to claim 1, wherein the conveyor screw is rotatably supported on the drill pipe in the end portion of the drill pipe.

* * * * *